US005759119A

United States Patent [19]

Ayoub

[11] Patent Number: 5,759,119

[45] Date of Patent: Jun. 2, 1998

[54] GOLF TEE FOR HOLDING A LID OF A CONTAINER

[76] Inventor: George T. Ayoub, 818 Montgomery St., Fall River, Mass. 02720

[21] Appl. No.: 797,847

[22] Filed: Feb. 10, 1997

[51] Int. Cl.[6] ..... A63B 57/00

[52] U.S. Cl. ..... 473/387; 473/398; 229/906; 206/525; 426/124

[58] Field of Search ..... 473/387, 388, 473/398, 399, 400, 401; 248/346.01, 351, 684, 688; 206/525, 542; 229/906; 426/124, 128

[56] References Cited

U.S. PATENT DOCUMENTS

| | | | |
|---|---|---|---|
| 3,114,557 | 12/1963 | Cabot | 473/398 |
| 3,408,079 | 10/1968 | Kirkos | 473/398 |
| 3,883,144 | 5/1975 | Lazrow | 473/398 |
| 4,498,586 | 2/1985 | Vitale | 206/525 |
| 4,877,609 | 10/1989 | Beck et al. | 206/525 |
| 5,052,689 | 10/1991 | Lettrich | 473/398 |
| 5,077,050 | 12/1991 | Wall | 426/124 |
| 5,480,031 | 1/1996 | Maultasch et al. | 206/525 |
| 5,509,601 | 4/1996 | Drabick | 426/124 |
| 5,542,540 | 8/1996 | Knapp et al. | 426/128 |
| 5,571,055 | 11/1996 | Lewis et al. | 473/398 |

*Primary Examiner*—Steven B. Wong

*Attorney, Agent, or Firm*—Patent & Trademark Services; Joseph H. McGlynn

[57] ABSTRACT

A conventional golf tee comprising a circular member connected along the cylindrical region of the golf tee used to support the lid of a cardboard box such as a pizza box. The tee and circular member are inserted into a hole in the lid of a pizza box so that the point of the tee is placed downward and the lid of the box rests on the circular member. This arrangement is used in a pizza box, with the point of the tee placed in the pizza, and the circular member used to prevent the pizza box lid from sagging onto the pizza's surface. Furthermore, after use as a support piece for the pizza box, the tee may be used as a normal golf tee or as a spinning toy.

2 Claims, 1 Drawing Sheet

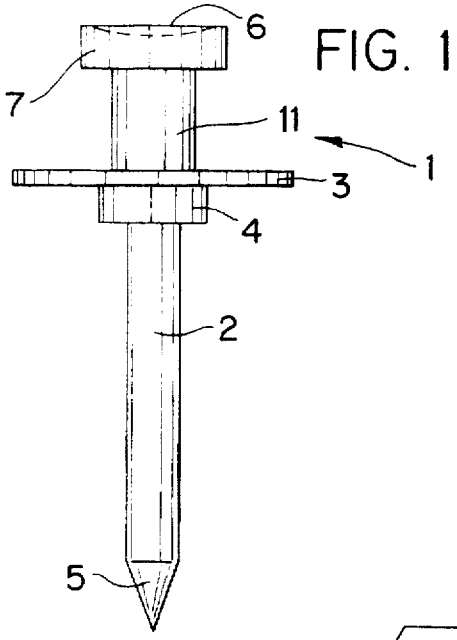
FIG. 1
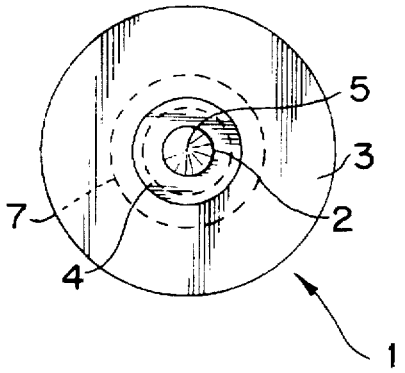
FIG. 2
FIG. 3
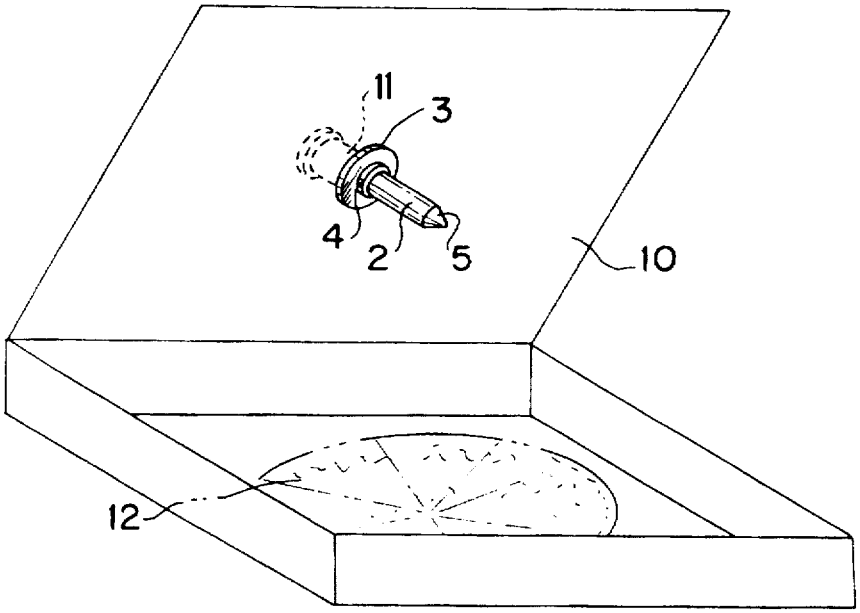
FIG. 4
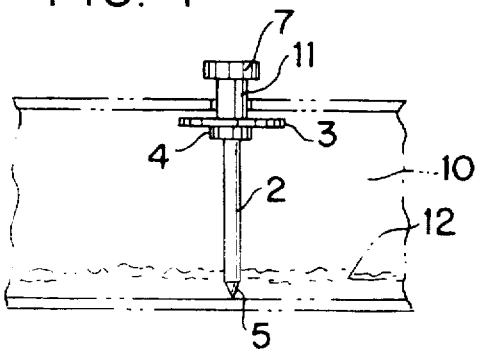
FIG. 5
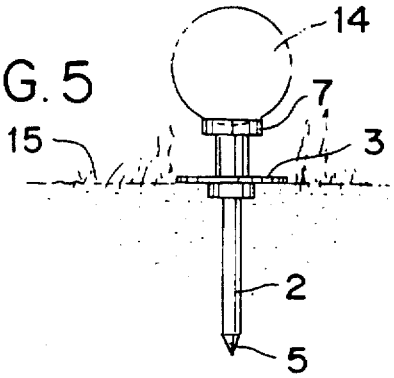

GOLF TEE FOR HOLDING A LID OF A CONTAINER

BACKGROUND OF THE INVENTION

This invention relates generally to free standing vertical support members and, more particularly, to a support for holding a lid of a container.

DESCRIPTION OF THE PRIOR ART

Numerous inventions relating to golf tees have been proposed in the prior art. Often, they seek to allow the adjustment of the vertical position of a golf ball when placed upon a tee. U.S. Pat. No. 3,883,144 discloses a golf tee including horizontal arms for locating the ball receiving portion thereof at a selected level with respect to the ground when the tee is inserted into the ground. Such horizontal arms are further adapted to maintain the tee in a true vertical position and to provide visual indicators for directing the proper location of the player's stance or driving position.

U.S. Pat. No. 3,408,079 discloses a golf tee having a peg and a stop member slidable on the peg. A portion of the peg is square in cross section with slits made therein at the corners. The stop member has a square hole therethrough of a size that permits rotation, but of less than 360 degrees, of it in said slit, hence the stop member can be friction-locked on the peg.

U.S. Pat. No. 3,114,557 discloses a golf tee having a vertically adjustable ground engaging collar. The tee is composed so that the seat for the ball is adapted to be adjustably arranged at predetermined heights above the ground, with means for conveniently and positively controlling the adjustment of the seat.

U.S. Pat. No. 5,052,689 discloses a golf ball and golf tee support structure that also limits the depth to which a tee may be inserted into the ground, thereby adjusting the elevation of the tee above the ground and providing a platform for the golf ball that is the proper elevation to meet the needs of the particular golfer. The structure includes a tubular support that accepts either a tee, or a ball without use of a tee, and which is provided with annular grooves around its outer periphery to facilitate cutting the tubular member to whatever height is best suited to the golfer.

All of the prior art devices have been employed only as supports for golf balls, that is, as golf tees. The possibility remains of a new use of a golf tee as a support member for other items, such as cardboard pizza boxes.

SUMMARY OF THE INVENTION

The present invention comprises a conventional golf tee with a circular member connected along the cylindrical region of the golf tee used to support the lid of a cardboard box such as a pizza box. The tee and circular member are inserted into a hole in the lid of a pizza box so that the point of the tee is placed downward and the lid of the box rests on the circular member. This arrangement is used in a pizza box, with the point of the tee placed in the pizza, and the circular member used to prevent the pizza box lid from sagging onto the pizza's surface. Furthermore, after use as a support piece for the pizza box, the tee may be used as a normal golf tee or as a spinning toy.

Accordingly, it is an object of this invention to utilize a golf tee for a purpose heretofore not explored, namely the support of the lid of a box above its contents.

It is a further object of this invention that said box be a pizza box and said contents be a pizza.

Finally, it is an object of this device that it serve a function after its use a pizza box lid support piece.

BRIEF DESCRIPTION OF THE DRAWINGS

FIG. 1 shows a side view of the present invention.

FIG. 2 shows a bottom view of the present invention.

FIG. 3 shows a perspective view of the device as it is inserted into a box lid for use.

FIG. 4 shows a side view of a section of the invention in use.

FIG. 5 shows a side view of the present invention in an alternate use as a normal golf tee.

DESCRIPTION OF THE PREFERRED EMBODIMENT

Referring now to the drawings, there is shown in FIG. 1 the present invention 1 comprising a conventional golf tee 2, with a pointed end 5 and a normal divoted end 6 on head 7 designed for holding a golf ball, and a connected circular support piece 3, which is concentrically located with the tee 2. The circular support piece 3 is connected to the tee 2 slightly below the divoted end 6 so that the circular face of the support piece 3 is perpendicular to the longitudinal axis of the tee 2 when the tee 2 is in the upright position. In this way, the circular support piece 3 rests in a horizontal position when the tee 2 is stood upright on its pointed end 5.

FIG. 2 shows that when the support piece 3 is oriented as previously described, there is connected to it on its underside a smaller circular support piece 4 oriented in a concentric fashion with the tee 2. In this way, the tee 2 is connected to the connecting piece 4, which in turn is adhered to the underside of the circular support piece 3.

FIG. 3 shows that in use, the device is inserted through a hole 11 in a box lid 10 so that the point 5 of the tee 2 remains inside the box 10, while the divoted end 6 goes through the hole 11. The hole 11 is large enough to accommodate this divoted end 6 passing through, but not so large as to allow the circular support piece 3 to pass, thereby assuring that the box lid 10 will rest on top of the circular support piece 3 when the box lid 10 is closed, as shown in FIG. 4. In this configuration, the pointed end 5 of the tee 2 is driven through the pizza 12 and will engage the bottom of the box. By preventing the box lid 10 from sagging, the circular support member 3 protects the top of the pizza 12.

The exact usage of the device may vary according to the pizza box 10 which it is used with. In some instances, a single device I may be used in the box, if the box is small, or if the box has multiple lid sections with holes that form a complete lid. If the box is large, multiple devices may be used in order to ensure that the box lid 10 does not come into contact with the surface of the pizza 12 in any location.

After use in a pizza box, the device may be used as a conventional golf tee, as shown in FIG. 5. In this form, a golf ball 14 is placed on the divoted end 6, while the tee 2 is driven into the ground in a conventional fashion, with the pointed end 5 in the ground. The circular support member 3 is placed at ground level 15, adding lateral support to the tee 2. The device might also be used as a spinning toy. In this use, the device is spun by the user on the pointed end 5 in an upright manner about the axis of the tee 2.

The construction of this device is not crucial to its function, and material selection should be made so that costs are minimized. Accordingly, plastic would be an ideal selection for all parts of the device, though any other material which satisfies the requirements described herein would be acceptable. The different sections of the device might be adhered by any normal adhesive or joining method, though the manufacture of all pieces as a unitary device stands as the best option.

Although the tee and supporting device and the means of using the same according to the present invention have been described in the foregoing specification with considerable detail, it is to be understood that modifications may be made to the invention which do not exceed the scope of the appended claims, and modified forms of the present invention done by others skilled in the art to which the invention pertains will be considered infringements of the invention when those modified forms fall within the claimed scope of this invention.

What I claim as my invention is:

1. A support in combination with a container, said container having a bottom with an inner and outer surface and a lid with an inner surface facing said inner surface of said bottom, said golf tee having a longitudinally extending portion with a pointed tip at one end, said support having a second end with a radially extending portion affixed adjacent said second end, said support second end extending through said lid, said radially extending portion engaging said lid inner surface, and said pointed tip engaging said bottom inner surface.

2. A new use for a golf tee, said golf tee comprising:

a longitudinally extending portion with a pointed tip at one end, said support having a second end with a radially extending portion affixed adjacent said second end, said new use comprising:

using said golf tee as a support for a box having a lid, by attaching said second end to said lid so that said second end extends through said lid, and said radially extending portion engages an inner surface of said lid, attaching said pointed end to a bottom surface of said box, whereby said support will prevent said lid from contacting an article in said box.

* * * * *